US009626944B1

(12) United States Patent
Liao

(10) Patent No.: US 9,626,944 B1
(45) Date of Patent: Apr. 18, 2017

(54) MUSICAL INSTRUMENT PEDAL WITH DRUMSTICK ANGLE ADJUSTMENT STRUCTURE

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 15/236,984

(22) Filed: Aug. 15, 2016

(51) Int. Cl.
*G10D 13/00* (2006.01)

(52) U.S. Cl.
CPC ..... *G10D 13/006* (2013.01)

(58) Field of Classification Search
CPC ..... G10D 13/006; G10D 13/003
USPC ..... 84/422.1, 422.2, 422.3
See application file for complete search history.

(56) References Cited

U.S. PATENT DOCUMENTS 5,297,467 A * 3/1994 Hoshino ..... G10D 13/006 84/422.1

5,574,237 A * 11/1996 Yanagisawa ..... G10D 13/006 84/422.1

* cited by examiner

*Primary Examiner* — Kimberly Lockett
(74) *Attorney, Agent, or Firm* — Muncy, Geissler, Olds & Lowe, P.C.

(57) ABSTRACT

A musical instrument pedal with a drumstick angle adjustment structure comprises a drumstick, a rotation shaft, a stand frame, a pedal base, a pedal, and a chain. The drumstick is fixed to the rotation shaft. The stand frame includes a vertical rod pivotally coupled to the rotation shaft. The pedal base includes a fixed member connected with the stand frame to secure the stand frame, a mobile member slidable with respect to the fixed member, and a screw fastening the fixed member to the mobile member. Two ends of the chain are respectively connected with the pedal and the rotation shaft. Thereby, the relative position of the mobile member and the fixed member can be varied to drag the chain to rotate the rotation shaft, change the drumstick angle, vary the force strength of beating the drum skin, and generate different drum sounds for different melodies.

9 Claims, 8 Drawing Sheets

MUSICAL INSTRUMENT PEDAL WITH DRUMSTICK ANGLE ADJUSTMENT STRUCTURE

FIELD OF THE INVENTION

The present invention relates to a musical instrument pedal, particularly to a musical instrument pedal with a drumstick angle adjustment structure.

BACKGROUND OF THE INVENTION

Refer to FIG. 1 for a conventional musical instrument pedal. The conventional musical instrument pedal comprises a pedal base 1, a stand frame 2, a rotation shaft 3, a pulley 4, a drumstick seat 5, a drumstick 6, a pedal 7 and a belt 8. The stand frame 2 is vertically disposed before the pedal base 1. The rotation shaft 3 is horizontally disposed on and pivotally coupled to the upper region of the stand frame 2. The rotation shaft 3 penetrates the pulley 4. The drumstick seat 5 is installed on one side of the pulley 4. The drumstick 6 is assembled to the drumstick seat 5. The rear end of the pedal 7 is pivotally coupled to the rear region of the pedal base 1. The front end of the pedal 7 is connected with the lower end of the belt 8. The upper end of the belt 8 is engaged with the rim of the pulley 4. Thereby, the pedal 7 is in a front-up and rear-down status.

While pushed down by the performer, the pedal 7 pulls down the belt 8, driving the pulley 4 to rotate. Thus, the drumstick seat 5 is rotated synchronously to drive the drumstick 6 to beat the drum skin of a drum (not shown in the drawing). The angle at which the drumstick 6 is assembled to the drumstick seat 5 directly determines the force strength at which the drumstick 6 beats the drum skin. The greater the force strength of beating the drum, the more sonorous the drum sound; the smaller the force strength of beating the drum, the milder the drum sound. Therefore, the performer would change the angle of the drumstick 6 to adjust the force strength of beating the drum according to the played music.

In practical operation, while intending to adjust the angle of the drumstick 6, the user needs to change the position where the drumstick seat 5 is engaged with the rotation shaft 3 and thus has to dismount the entire drumstick seat 5, which is pretty troublesome and likely to cause abrasion and loosening of the drumstick seat 5. Besides, while intending to collect the conventional musical instrument pedal, the user must disassemble the pedal base 1 from the stand frame 2 in a complicated process before the pedal base 1 and the stand frame 2 can be parallel placed together for collection. Therefore, the conventional musical instrument pedal is hard to meet the requirement of users.

SUMMARY OF THE INVENTION

The primary objective of the present invention is to provide a musical instrument pedal whose drumstick angle can be changed conveniently.

In order to achieve the abovementioned objective, the present invention proposes a musical instrument pedal with a drumstick angle adjustment structure, which comprises a drumstick, a rotation shaft, a stand frame, a pedal base, a pedal, and a chain. The drumstick is fixed to the rotation shaft. The stand frame includes a vertical rod pivotally coupled to the rotation shaft. The pedal base includes a fixed member connected with the stand frame to secure the stand frame, a mobile member slidable with respect to the fixed member, and a screw fastening the fixed member to the mobile member. The pedal is pivotally coupled to the mobile member. Two ends of the chain are respectively connected with the pedal and the rotation shaft, and the pedal is dragged to be in a tilted status by the chain.

As long as the screw is loosened, the mobile member can be moved with respect to the fixed member. While the position of the pedal is changed, the pedal drags the chain to rotate the rotation shaft and vary the angle of the drumstick. Once the angle of the drumstick is changed, the force strength of beating the drum skin is also changed. Thus, the present invention enables the user to fast and conveniently change the drumstick angle to generate different drum sounds for different melodies. Therefore, the present invention can satisfy the requirement of users.

DETAILED DESCRIPTION OF THE PREFERRED EMBODIMENTS

The technical contents of the present invention will be described in detail with embodiments below. However, it should be understood: these embodiments are only to exemplify the present invention but not to limit the scope of the present invention.

Figure 1:
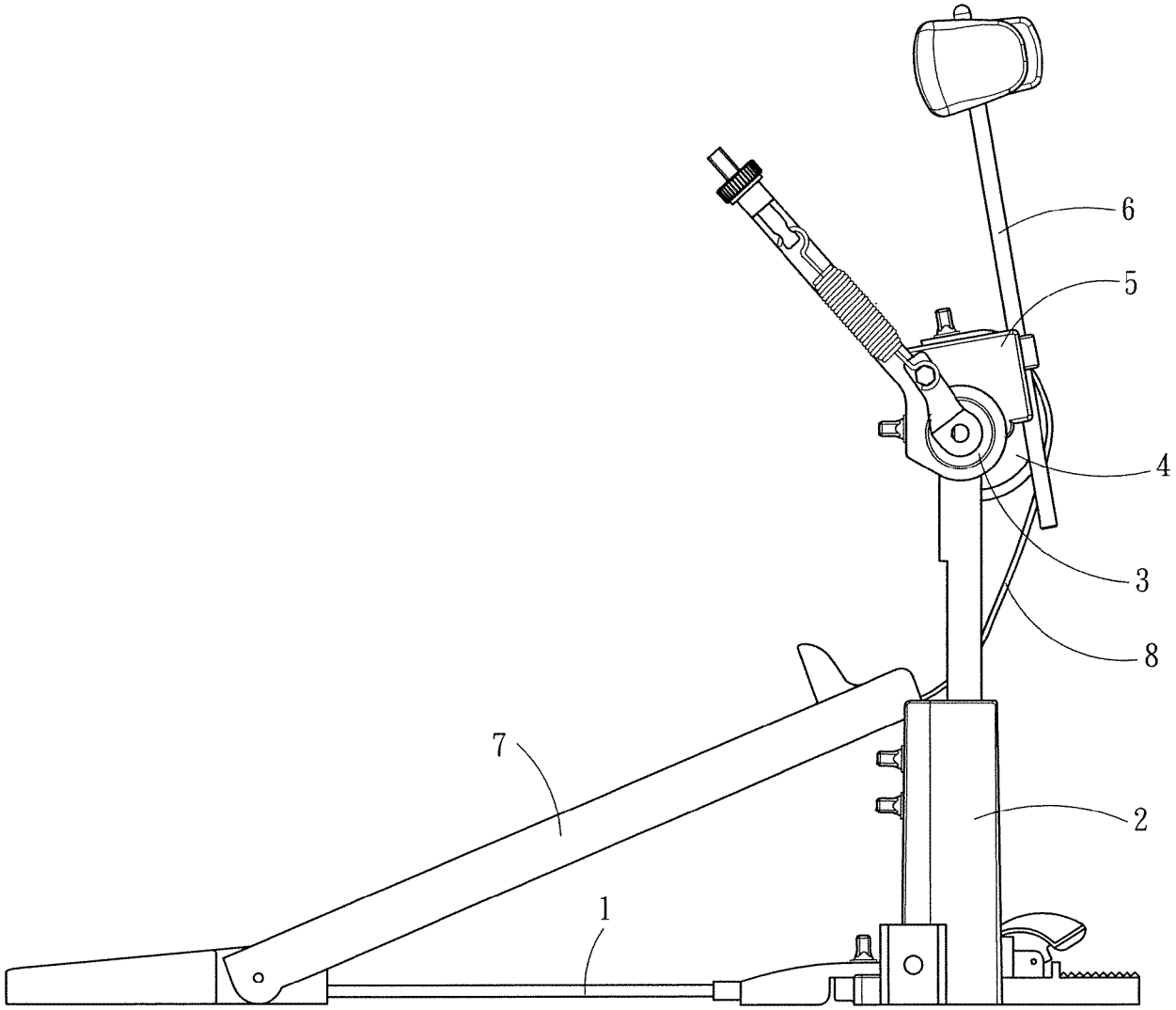
Fig. 1 PRIOR ART
FIG. 1 is a perspective view schematically showing a conventional musical instrument pedal.
Figure 2:
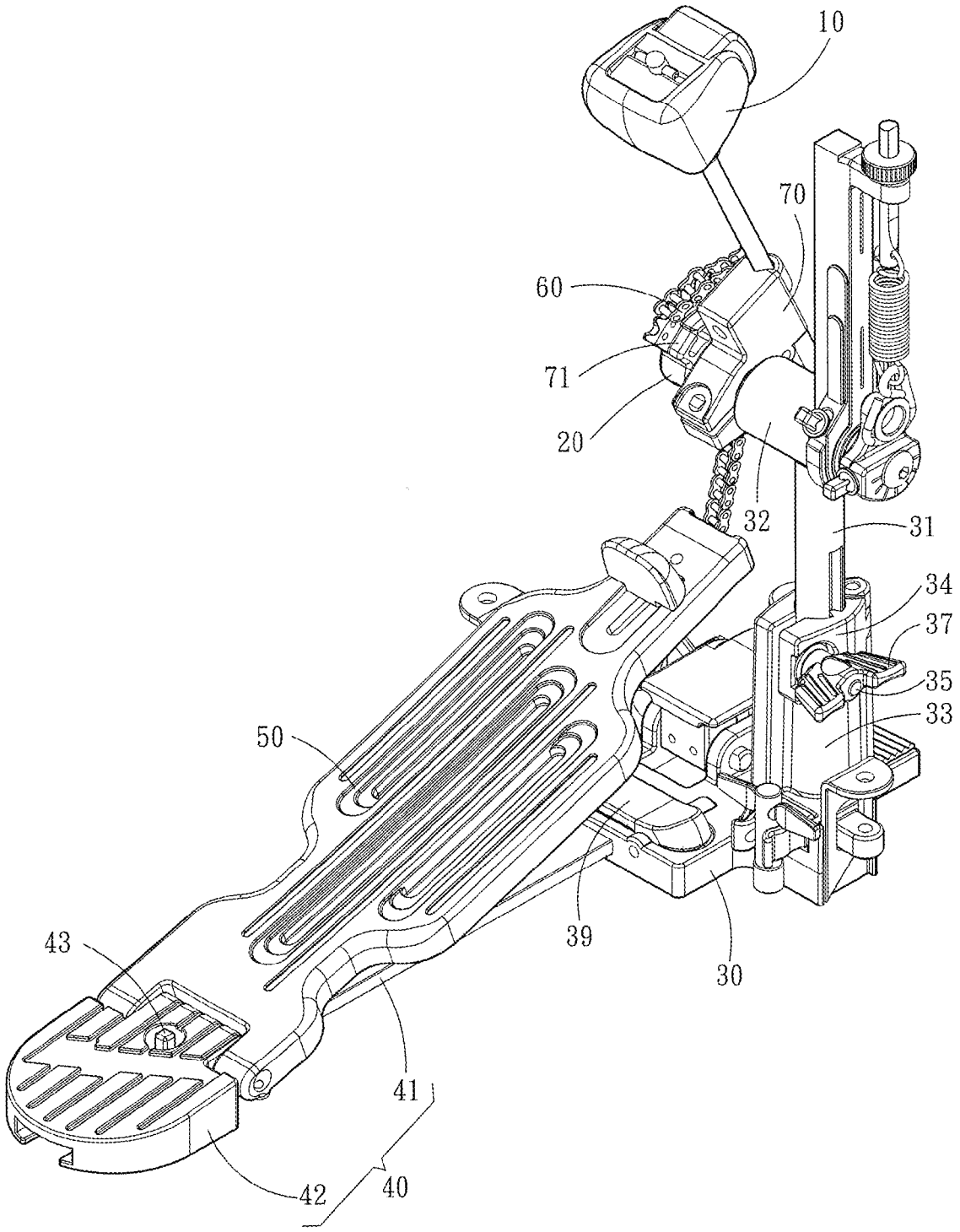
FIG. 2 is a perspective view schematically showing the structure of a musical instrument pedal with a drumstick angle adjustment structure according to one embodiment of the present invention.
Figure 3:
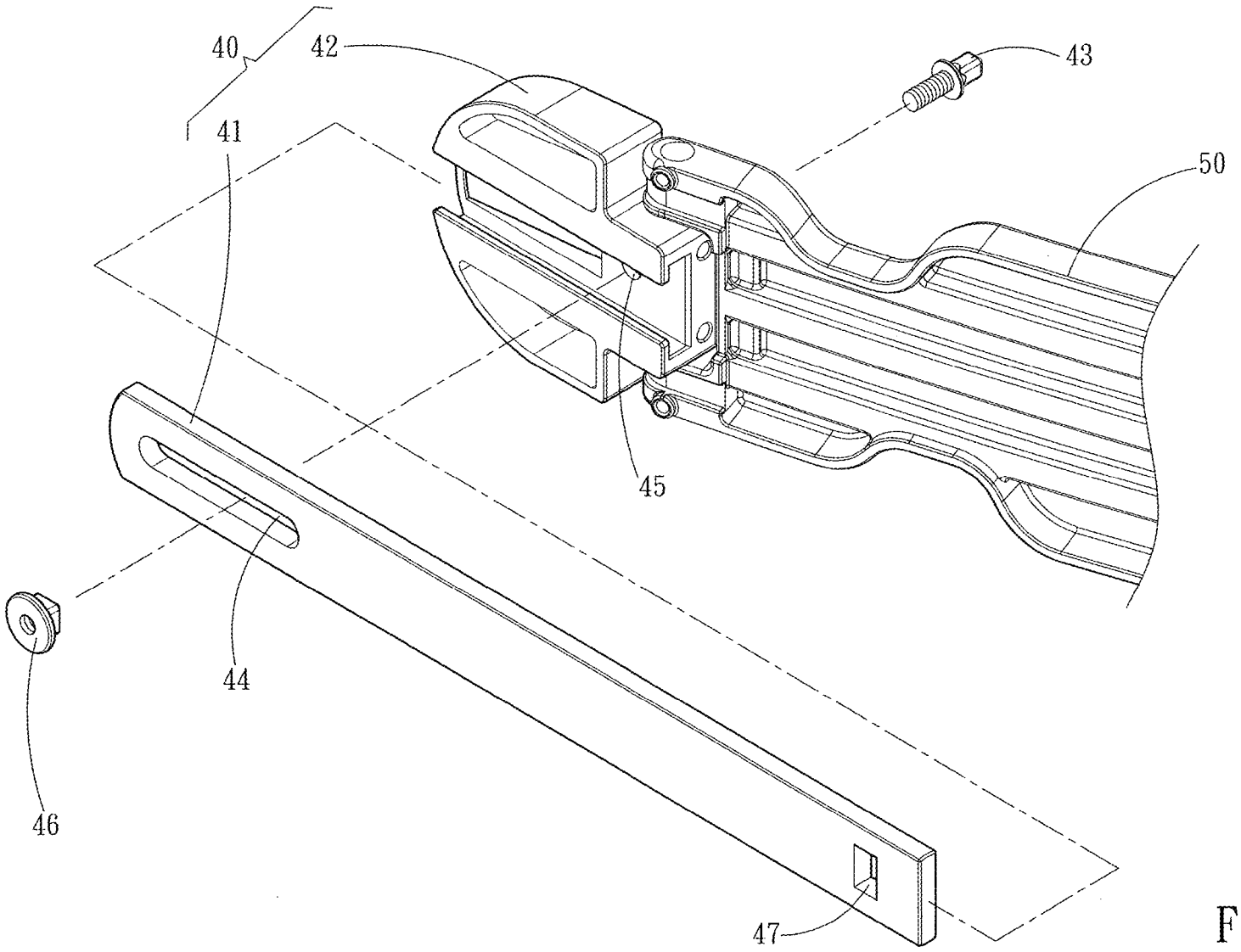
FIG. 3 is an exploded view schematically showing a local structure of a musical instrument pedal with a drumstick angle adjustment structure according to one embodiment of the present invention.

Refer to FIG. 2 and FIG. 3. The musical instrument pedal with a drumstick angle adjustment structure of the present invention comprises a drumstick 10, a rotation shaft 20, a stand frame 30, a pedal base 40, a pedal 50, and a chain 60. The drumstick 10 is fixed to the rotation shaft 20. In one embodiment, the present invention further comprises a drumstick seat 70; the drumstick 10 is fixed to the drumstick seat 70, and the drumstick seat 70 is fixed to the rotation shaft 20. In one embodiment, the stand frame 30 includes a vertical rod 31 pivotally coupled to the rotation shaft 20. In one embodiment, a column 32 is horizontally extended from the vertical rod 31, facilitating the pivotal coupling of the rotation shaft 20. In other words, the rotation shaft 20 can rotate with respect to the column 32.

The pedal base 40 includes a fixed member 41 connected with the stand frame 30 to secure the stand frame 30, a mobile member 42 slidable with respect to the fixed member 41, and a screw 43 fastening the fixed member 41 to the mobile member 42. In one embodiment, the fixed member 41 includes a long slot 44, and the mobile member 42 includes a through-hole 45 corresponding to the long slot 44. The screw 43 is screwed into a nut 46 disposed inside the long slot 44 to fix the relative position of the fixed member 41 and the mobile member 42. The pedal 50 is pivotally coupled to the mobile member 42. Two ends of the chain 60 are respectively connected with the pedal 50 and the rotation shaft 20, and the pedal 50 is dragged to be in a tilted status by the chain 60. In one embodiment, the chain 60 is connected with the rotation shaft 20 through a sprocket wheel 71 to enhance the force strength of beating the drum.

Figure 4:
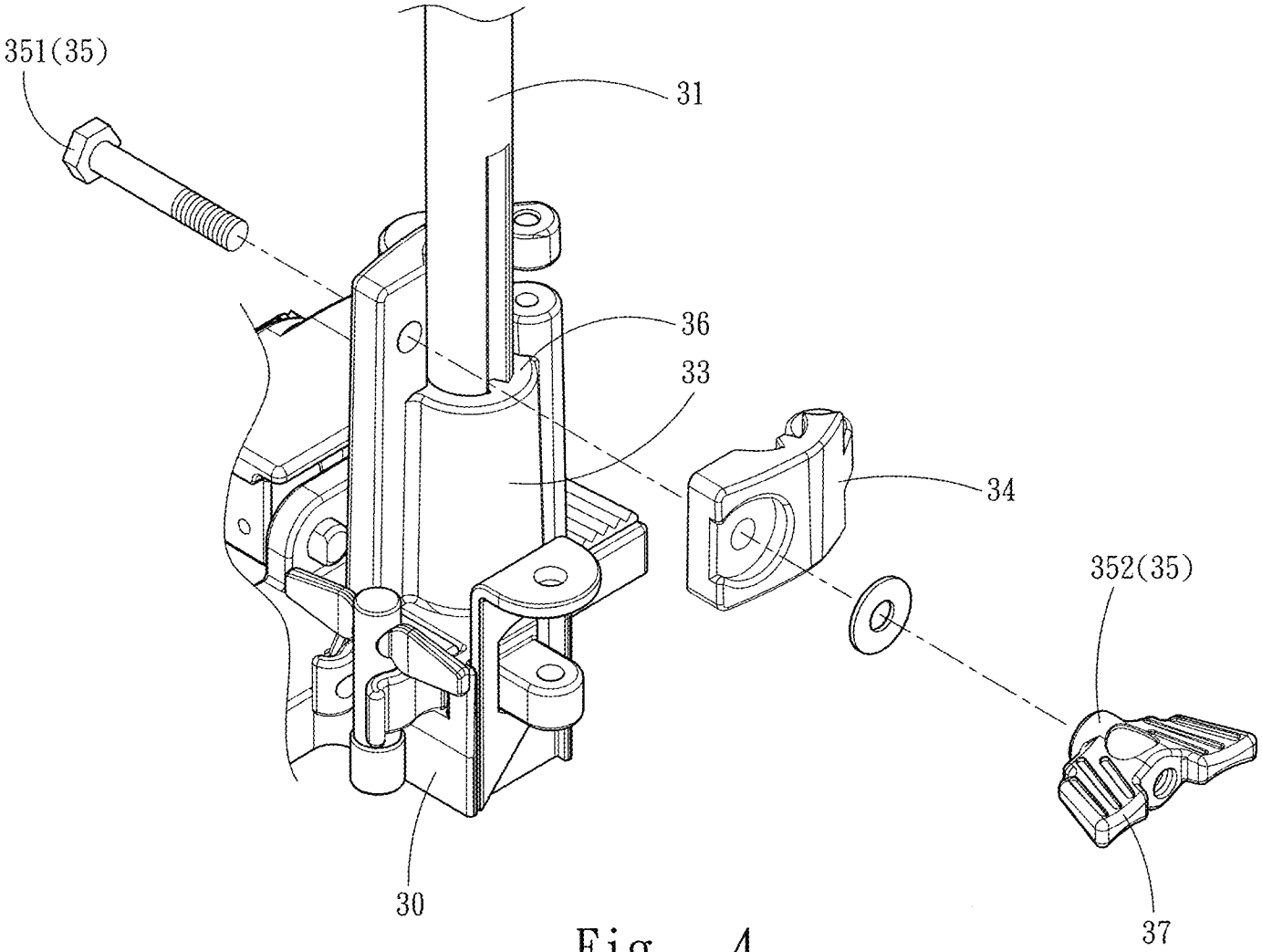
FIG. 4 is an exploded view schematically showing another local structure of a musical instrument pedal with a drumstick angle adjustment structure according to one embodiment of the present invention.

Refer to FIG. 4. The stand frame 30 includes a sleeve pipe 33, a gripping plate 34, and a fastening-screw member 35. The fastening-screw member 35 includes a bolt 351 and a nut 352. The vertical rod 31 is moveably inserted into the sleeve pipe 33. The gripping plate 34 is pivotally coupled to the sleeve pipe 33. The fastening-screw member 35 is inserted through the gripping plate 34. The bolt 351 is screwed into the nut 352 to clamp the gripping plate 34 tightly and fix the vertical rod 31. In one embodiment, the sleeve pipe 33 includes a recess 36 to receive the gripping plate 34; the nut 352 includes two wings 37 respectively extended from two lateral sides thereof to convenience the user in rotating the nut 352.

Figure 5:
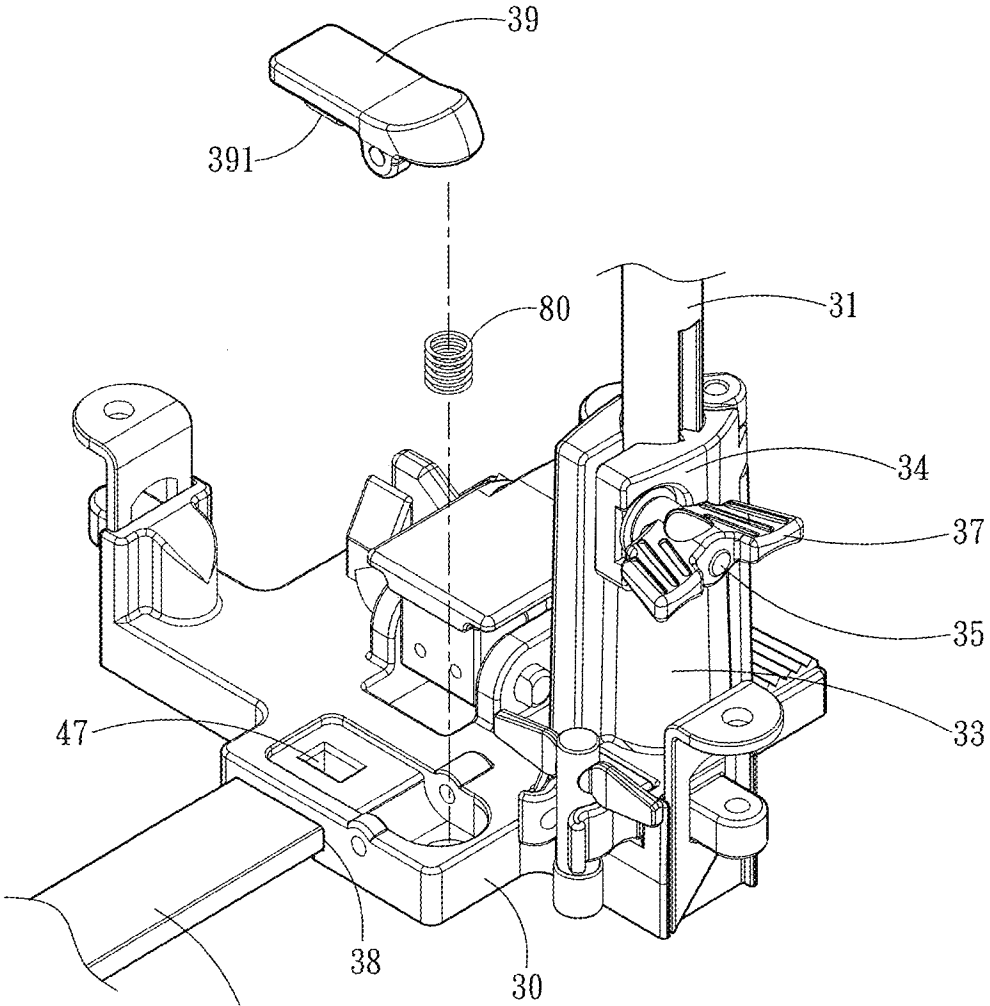
FIG. 5 is an exploded view schematically showing a further local structure of a musical instrument pedal with a drumstick angle adjustment structure according to one embodiment of the present invention.

Refer to FIG. 5. In one embodiment, the stand frame 30 includes an insert slot 38 allowing a fixing hole 47 of the fixed member 41 to be inserted; and a press-fit element 39 press-fitting the fixed member 41. The press-fit element 39 is pivotally coupled to the stand frame 30 and includes a protrusion 391 to be press-fitted into the fixing hole 47. In one embodiment, a spring 80 is arranged between the press-fit element 39 and the stand frame 30 to normally press-fit the protrusion 391 into the fixing hole 47. While the protrusion 391 is separated from the fixing hole 47, the fixed member 41 can be detached from the stand frame 30. In such a case, the entire musical instrument pedal can be collapsed into a bar-like structure and collected conveniently.

Figure 6A:
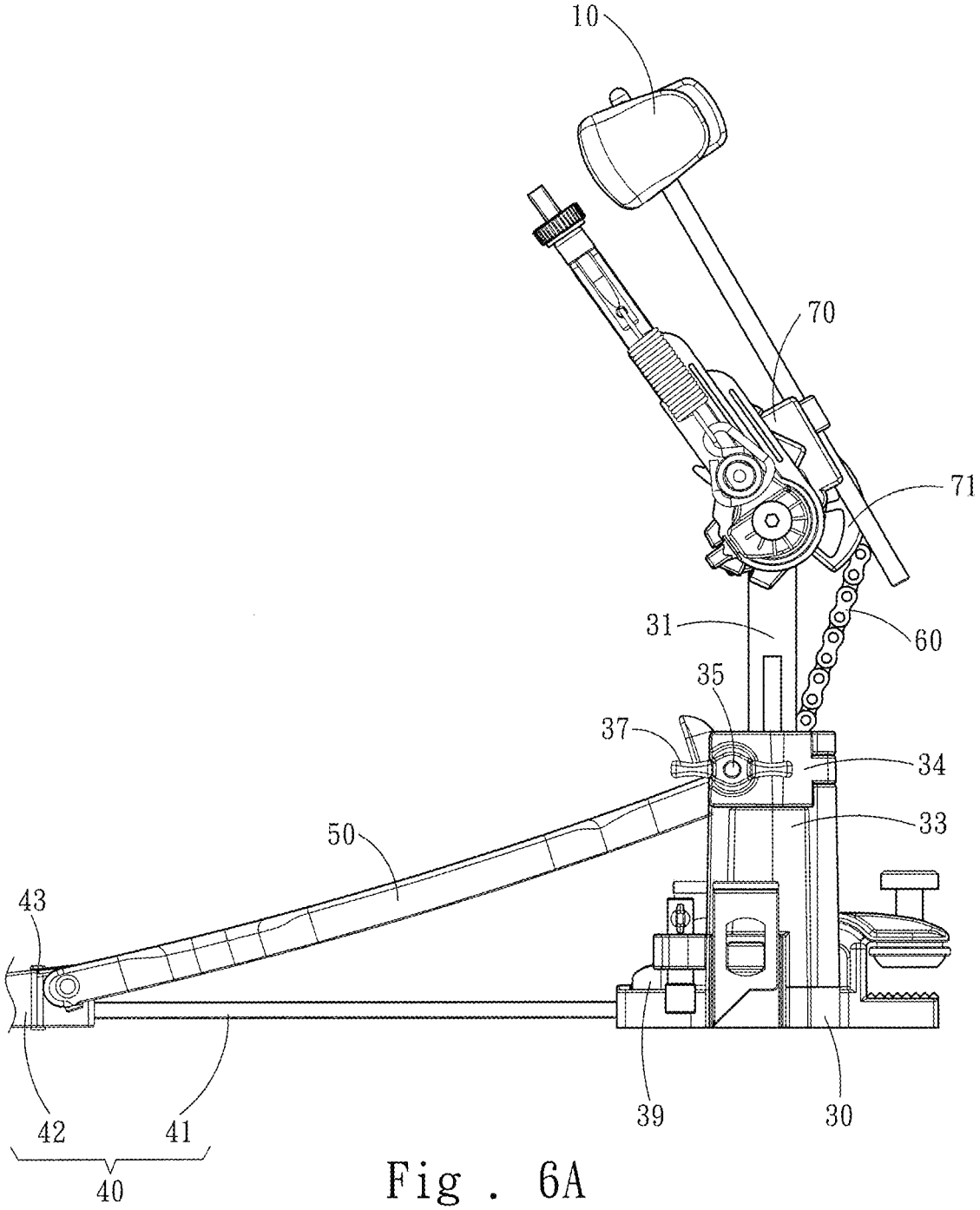
FIG. 6A is a side view schematically showing the structure of a musical instrument pedal before the drumstick angle is adjusted according to one embodiment of the present invention.
Figure 6B:
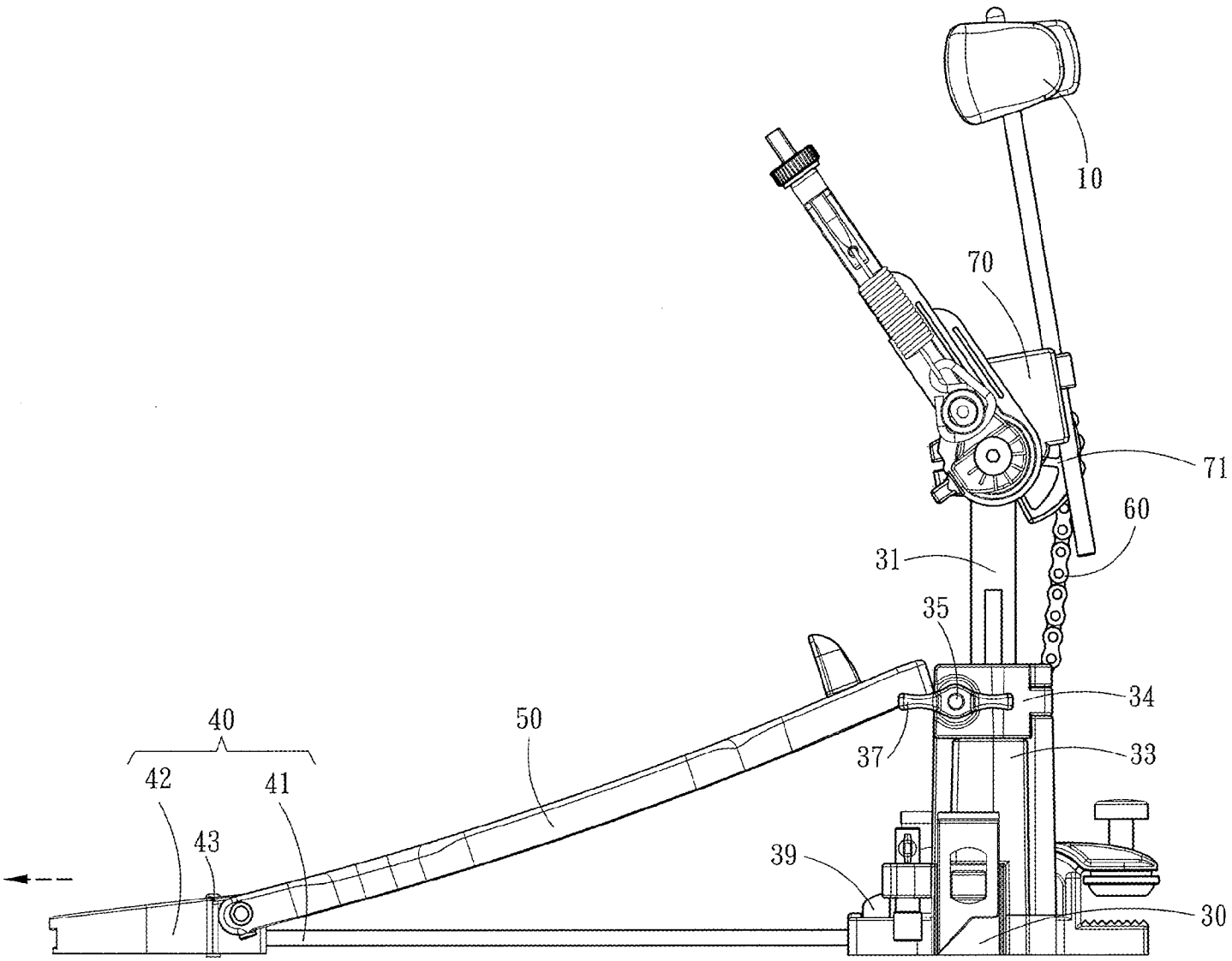
FIG. 6B is a side view schematically showing a method of adjusting the drumstick angle according to one embodiment of the present invention.
Figure 6C:
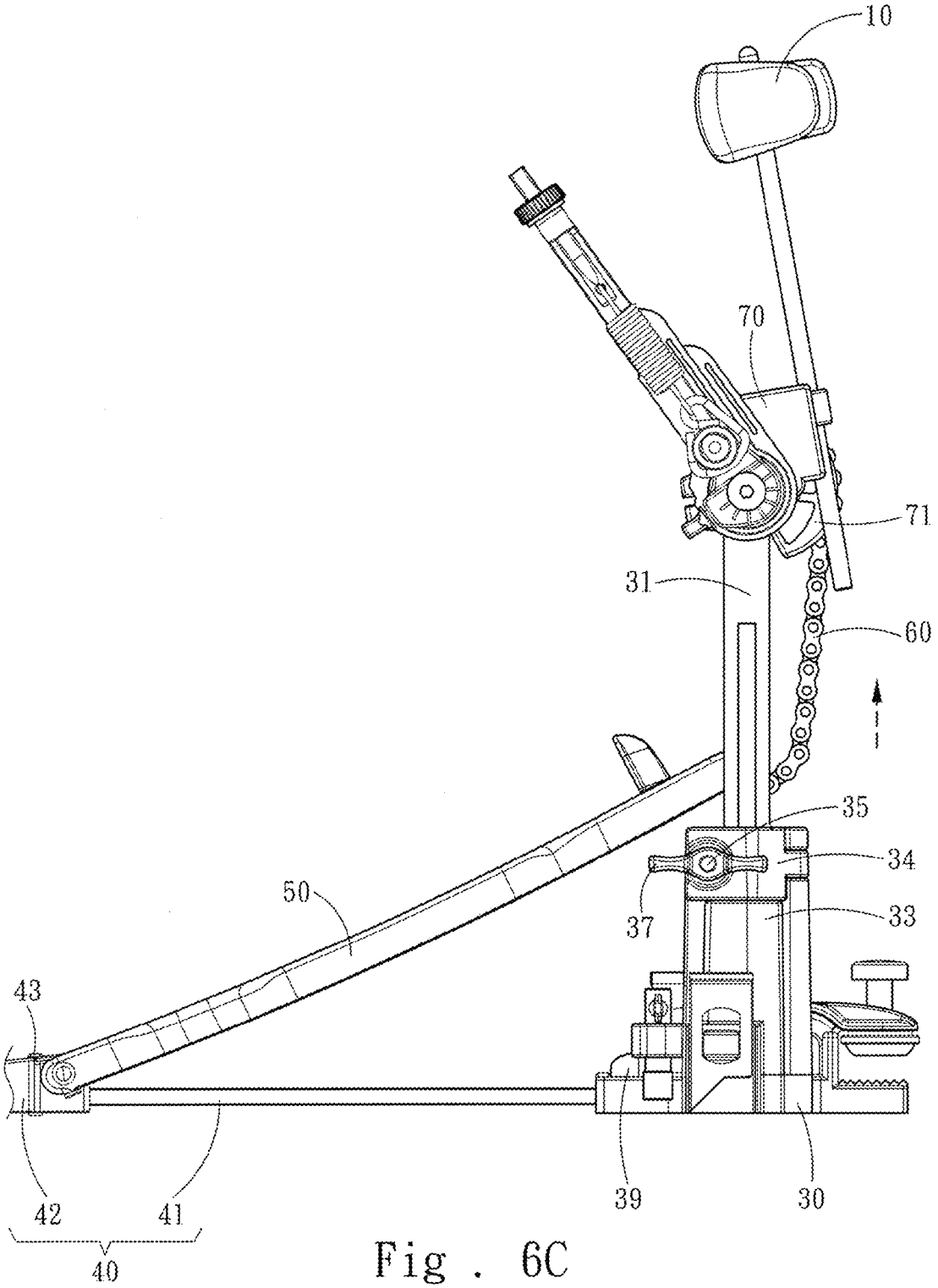
FIG. 6C is a side view schematically showing another method of adjusting the drumstick angle according to one embodiment of the present invention.

Refer to FIGS. 6A-6C. Initially, the drumstick 10 is at the angle shown in FIG. 6A. At this time, as long as the user loosens the screw 43, the nut 46 becomes slidable in the long slot 44. Then, the user can move the mobile member 42 with respect to the fixed member 41 to change the position of the pedal 50 and drag the chain 60 to rotate the rotation shaft 20. Thus, the angle of the drumstick 10 is varied, as shown in FIG. 6B. Next, the screw 43 is locked tightly to fix the angle of the drumstick 10. Alternatively, the user loosens the fastening-screw member 35 to vary the altitude of the vertical rod 31 and thus vary the altitude of the rotation shaft 20. In such a case, the rotation shaft 20 is dragged by the chain 60 to rotate, whereby the angle of the drumstick 10 is changed, as shown in FIG. 6C. Then, the fastening-screw member 35 is locked tightly to fix the angle of the drumstick 10.

As mentioned above, via varying the relative position of the mobile member and the fixed member or via varying the altitude of the vertical rod (rotation shaft), the chain is dragged to rotate the rotation shaft, whereby to change the drumstick angle and vary the force strength of beating the drum skin. Thus, the present invention enables the user to fast and conveniently change the drumstick angle to generate different drum sounds for different melodies. Therefore, the present invention can satisfy the requirement of users.

What is claimed is:

1. A musical instrument pedal with a drumstick angle adjustment structure, comprising:

a drumstick;

a rotation shaft, which the drumstick is fixed to;

a stand frame, including a vertical rod pivotally coupled to the rotation shaft;

a pedal base, including a fixed member connected with the stand frame to secure the stand frame, a mobile member slidable with respect to the fixed member, and a screw fastening the fixed member to the mobile member;

a pedal, pivotally coupled to the mobile member; and a chain, whose two ends are respectively connected with the pedal and the rotation shaft, wherein the pedal is dragged to be in a tilted status by the chain, wherein the stand frame comprises:

an insert slot allowing a fixing hole of the fixed member to be inserted; and a press-fit element press-fitting the fixed member, and wherein the press-fit element is pivotally coupled to the stand frame and includes a protrusion to be press-fitted into the fixing hole.

2. The musical instrument pedal with a drumstick angle adjustment structure according to claim 1 further comprising a drumstick seat, wherein the drumstick is fixed to the drumstick seat, and wherein the drumstick seat is fixed to the rotation shaft.

3. The musical instrument pedal with a drumstick angle adjustment structure according to claim 1, wherein the stand frame includes a sleeve pipe, a gripping plate, and a fastening-screw member, and wherein the fastening-screw member includes a bolt and a nut, and wherein the vertical rod is moveably inserted into the sleeve pipe, and wherein the gripping plate is pivotally coupled to the sleeve pipe, and wherein the fastening-screw member is inserted through the gripping plate, and wherein the bolt is screwed into the nut to clamp the gripping plate tightly and fix the vertical rod.

4. The musical instrument pedal with a drumstick angle adjustment structure according to claim 3, wherein the sleeve pipe includes a recess to receive the gripping plate.

5. The musical instrument pedal with a drumstick angle adjustment structure according to claim 3, wherein the nut includes two wings respectively extended from two lateral sides thereof.

6. The musical instrument pedal with a drumstick angle adjustment structure according to claim 1, wherein a spring is arranged between the press-fit element and the stand frame to normally press-fit the protrusion into the fixing hole.

7. The musical instrument pedal with a drumstick angle adjustment structure according to claim 1, wherein the fixed member includes a long slot, and the mobile member includes a through-hole corresponding to the long slot, and wherein the screw is screwed into a nut disposed inside the long slot to fix the relative position of the fixed member and the mobile member.

8. The musical instrument pedal with a drumstick angle adjustment structure according to claim 1, wherein a column is horizontally extended from the vertical rod to facilitate pivotal coupling of the rotation shaft.

9. The musical instrument pedal with a drumstick angle adjustment structure according to claim 1, wherein the chain is connected with the rotation shaft through a sprocket wheel.

* * * * *